US005749561A

United States Patent [19]

Worthington

[11] Patent Number: 5,749,561

[45] Date of Patent: May 12, 1998

[54] PLUG ASSEMBLY

[75] Inventor: Albert Edward Worthington, Christchurch, New Zealand

[73] Assignee: Wes Wastes Limited, New Zealand

[21] Appl. No.: 726,079

[22] Filed: Oct. 4, 1996

[30] Foreign Application Priority Data

Oct. 31, 1995 [NZ] New Zealand ..... 280356

[51] Int. Cl.[6] ..... A47K 1/14; F16K 31/46; F16K 31/528

[52] U.S. Cl. ..... 251/229; 4/293; 4/295; 4/689; 251/252; 251/263; 251/322; 251/323; 251/344; 251/345; 251/346; 251/347; 251/348; 251/294

[58] Field of Search ..... 4/287, 293, 295, 4/684, 689, 693; 251/252, 263, 344, 345, 346, 347, 348, 349, 351, 352, 354, 321, 322, 323, 294; 74/56, 57, 500.5

[56] References Cited

U.S. PATENT DOCUMENTS 1,811,170 6/1931 Brotz ..... 4/689
4,764,993 8/1988 Oropallo ..... 4/689

FOREIGN PATENT DOCUMENTS

033131/78 8/1979 Australia ..... 4/689
480935 8/1929 Germany ..... 4/689

OTHER PUBLICATIONS

NZ, 244073 (Worthington) Aug. 25, 1992.
PCT/NZ96/00031 (Worthington and O'Connell), International Filing Date—Apr. 11, 1996.

*Primary Examiner*—George L. Walton
*Attorney, Agent, or Firm*—Seed and Berry LLP

[57] ABSTRACT

A plug assembly (2) which can be used in a drain, sink or bath (5). The plug (2) is of the pop up type being spring biassed into an open position. The plug (2) includes interengaging means for engagement of the plug (2) with a waste pipe (3) and means to permit the movement of the plug (2) relative to the pipe (3), both of which are circumferentially situated so that there is no impediment to fluid moving through the plug (2) and into the pipe (3). The means to bias the plug (2) to the open position includes a spring (18) which is arranged between the exterior of the plug (2) side and the interior of the waste pipe (3), and shoulders (6, 19) formed in each, such that said fluid flowing through the pipe (3) does not contact the spring (18). The plug (2) can be manually operated or operated remotely.

13 Claims, 2 Drawing Sheets

Fig. 1
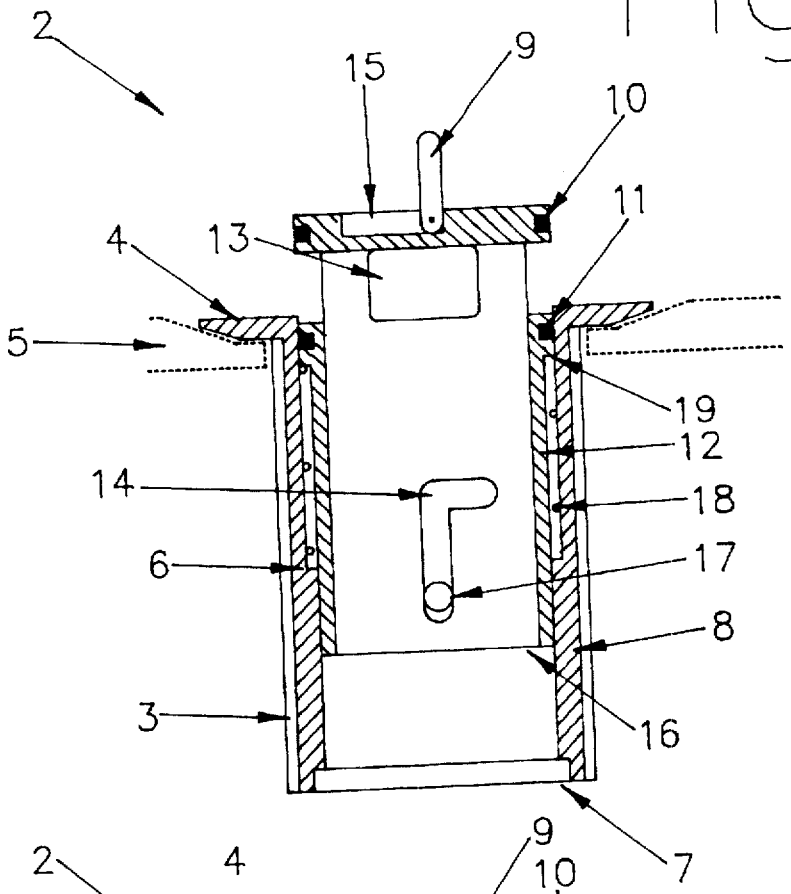
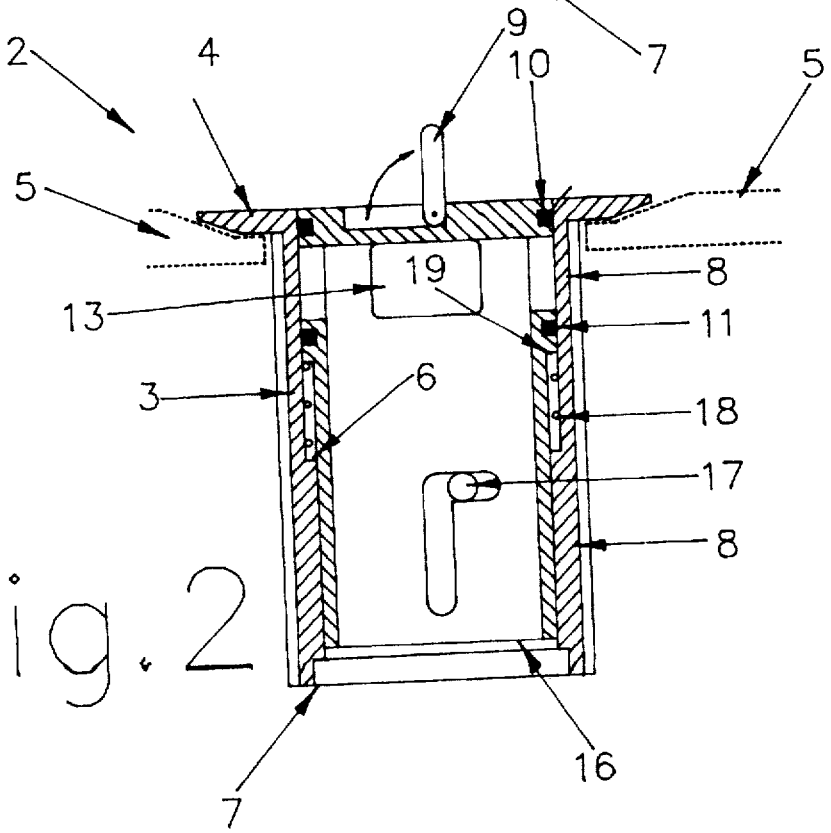
Fig. 2

PLUG ASSEMBLY

TECHNICAL FIELD

The present invention relates to a plug assembly for use in connection with domestic, commercial and industrial drains, sinks, baths.

BACKGROUND ART

New Zealand Patent No. 244073 discloses an improved plug assembly in which the plug and sink waste pipe unit includes inter-engaging means to secure the plug relative to the pipe wherein the plug can be rotated and remain in an open position and move between an open and closed position, without the plug being removable from the sink unit. The opening and closing unit includes means to open, close and retain the plug in an open position that are entirely peripheral or circumferential to the plug and sink unit so that there is no obstruction for fluid draining from the sink to the pipe. The means for retaining the plug in an open position includes a spring which biasses the plug to the open position and which is compressed when the plug is pushed and secured in the closed position.

This style of plug and means to retain plug in an open position is also used and described in PCT/NZ96/00031. However, in that disclosure the operation of the plug is controlled remotely.

The major problem with the operation of a spring means biassing a plug to an open position (of either a manual or remotely controlled plug as described above) is that the 20 spring or spring means is exposed to any waste fluid or water draining through the interior of the plug and into the pipe. It is possible for material to be retained in crevices or along edges of the spring and in gaps generated by the combination of the spring and the walls of the assembly unit.

DISCLOSURE OF THE INVENTION

An object of the present invention is to provide a plug assembly unit that can be used for either manual or remote operation, whereby there is no direct contact between the fluid or waste going through the plug unit and drain in which the plug unit sits and the spring means biassing the plug in the open position.

The present invention provides a plug assembly unit including:

- a sink waste pipe unit of known type;
- a plug with a closed top and side with holes formed in the side for the draining of fluid therethrough;
- means for draining fluid from said sink to said pipe;
- means to move the plug between an open and the closed position;
- means to enable said plug to be left in an open position which includes a spring means;
- said plug assembly unit including inter-engaging means for said pipe and plug and means to secure said plug relative to said pipe such that said plug can be moved relative to said pipe but cannot be removed therefrom under normal operating conditions;
- wherein said opening means and means to leave the plug in the open position includes spring means positioned between the plug and the waste pipe; wherein
  - said plug can be moved between the open and the closed position and said fluids drain through one or more peripheral holes in said plug through the interior of said plug to the pipe; and

- wherein the arrangement of the plug sides, the means to enable the plug to be left in the open position and the opening means is such that said fluid does not touch said spring means when said fluid passes through said plug to the pipe.

Preferably said spring means is a spring and is referred to as a "shrouded spring" in that there is a shrouding between the spring and the interior of the plug and pipe which prevents the fluid flowing through the plug and pipe to touch the spring as fluid flows through.

Said plug assembly unit can be used in either a manually operated plug or a remotely operated plug.

The present invention further provides a plug assembly including:

- a plug with a closed top and side with holes formed in the side for the draining of fluid therethrough;
- means for draining fluid from said sink to a sink waste pipe;
- means to move the plug between an open and the closed position;
- means to enable said plug to be left in an open position which includes a spring means;
- said plug assembly unit including inter-engaging means for said pipe and plug and means to secure said plug relative to said pipe such that said plug can be moved relative to said pipe but cannot be removed therefrom under normal operating conditions; wherein
- said opening means and means to leave the plug in the open position includes spring means positioned between the plug and the waste pipe; wherein
  - said plug can be moved between the open and the closed position and said fluids drain through one or more peripheral holes in said plug through the interior of said plug to the pipe; and wherein
  - the arrangement of the plug sides, the means to enable the plug to be left in the open position and the opening means is such that said fluid does not touch said spring means when said fluid passes through said plug to the pipe.

BRIEF DESCRIPTION OF THE DRAWINGS

By way of example only, preferred embodiments of the present invention will be described in detail with reference to the accompanying drawings, in which:

FIG. 1 is a section view of a preferred embodiment of the present invention, with the plug in a open position;

FIG. 2 is the same section view as in FIG. 1, with the plug in the closed position.

BEST MODE FOR CARRYING OUT INVENTION

Figure 3:
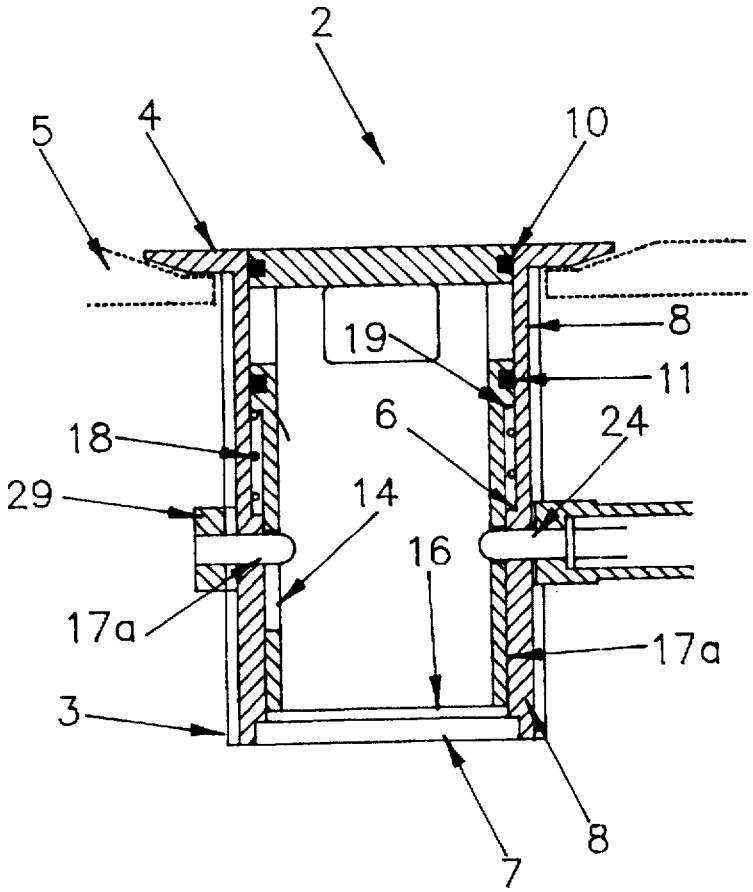
FIG. 3 is a section view of a second preferred embodiment of the plug unit to the present invention.

Referring to the FIGS. 1 and 2, a first preferred embodiment of the present invention for use with a manually operated plug is thereshown. The assembly includes a plug 2 and waste pipe 3. The waste pipe 3 is integrally formed with a flange 4 formed around the top of the waste pipe 3. The exterior of the waste pipe 3 is threaded in known fashion. The sink base 5, shown in dotted outline on the drawings, is of a standard type and the waste pipe 3 with flange 4 is fitted into the sink base 5 in known manner.

The interior wall of the waste pipe 3 is formed (for example, by machining) with a shoulder 6 approximately one half of the way along its length. Adjacent the base 7 of the waste pipe 3, the diameter of the interior of the waste pipe 3 is stepped outwards to increase the diameter thereof. Thus, the shoulder 6 and inset wall thickness of material 8 may be formed, if so desired, by the insertion and securement of a cylindrical sleeve to provide the shoulder 6. This is an alternative to machining the inside of the waste pipe 3.

The plug 2 includes: a handle 9; two grooves (10, 11) for placement therein of a rubber O-ring; a hollow cylindrical body 12 with two or more draining holes 13 positioned adjacent and between said pair of grooves (10, 11) and a shaped slot 14 positioned in the lower half of the length of the body 8.

The handle 9 may be secured to the plug 2 by a swivel pin in known fashion. The handle 9 may be shaped so that it can lie flat either on top of the plug or within a suitably shaped cavity (15) on the top of the plug 2. If so desired the handle 9 may be a permanent upright or sloping fixture and the top of the plug 2 may further include an indentation shaped to enable a finger or thumb to be inserted to push the plug 2 into a closed position.

The O-rings in the grooves 10, 11 provide a seal between the plug 2 and waste pipe 3 when the plug 2 is both in an open position and closed position. The draining holes 13 allow fluid to move from sink to the waste pipe 3 via the interior of the plug 2 within the cylindrical body 12 of the plug 2 and through the open end 16 of the plug 2.

The waste pipe 3 includes a hole 17 positioned such that a locking pin securely fitted therein is capable of engaging with the slot 14 in the plug 2. The pin is of a size that protrudes into the interior of the waste pipe 3 an equivalent to the thickness of the wall of the plug 2 such that when the pin inter-engages with the slot 14, it does not further intrude significantly into the interior of the plug 2. The shaped slot 14 is shaped so that when the plug 2 is in a closed position (FIG. 2) the pin is retained in the upper horizontal slot of the slot 14, thus retaining the plug 2 in a closed position.

The outside surface of the side of the plug 2 is shaped to form a shoulder 19 adjacent the lower of the two grooves 11. The size of the shoulder 19 and arrangement of the shoulder 19 is such that when the plug 2 inter-engages with the waste pipe 3, a small annular chamber is formed between the shoulder 19, exterior of the wall 12 of the plug 2, the shoulder 6 and the wall section of greater diameter, between the shoulder 6 and the flange 4, of the waste pipe 3. As can be seen in the difference in the size of this chamber between FIGS. 1 and 2, the length of this chamber will vary depending on whether the plug 2 is in the open position (FIG. 1) or in the closed position (FIG. 2).

Fitted within this chamber is a spring 18 of a size sufficient to still be under tension (that is, compressed) when the space is at its maximum volume (FIG. 1). The spring 18 is under further tension in FIG. 2, where the size of the chamber is smaller. Thus the spring 18 operates to maintain the plug 2 in an open position when the plug 2 is open. The interaction of the shape of the slot 14 and pin in hole 17 of the waste pipe 3 operate to maintain the plug 2 in a closed position after the plug 2 is pushed down and rotated. By twisting the handle 9, the plug 2 can be easily rotated so that the pin moves into the vertical portion of the slot 14 and the spring 18 operates to effect the opening of the plug 2. When the plug 2 is to be closed, the handle 9 or plug 2 is pushed down and rotated so that the pin moves into the horizontal portion of the slot 14 to retain the plug 2 in the closed position.

Whilst the slot 14 has been described with a vertical and a horizontal portion, it will be appreciated that other shapes will effect the same operation as the described shape.

Thus it can be seen, that in the operation of the plug 2 within the waste pipe 3, that the spring 18 comes into contact with little or no fluid flowing through the plug 2; thereby creating a plug 2 that can be operated in an almost perfectly hygenic manner.

The plug 2 and waste pipe 3 may be made of the same or of separate materials that are suitable for such componentry. For example, the plug 2 may be of brass and the waste pipe 3 of a plastics material. Alternatively, one may be of stainless steel and one may be a brass or a mixture thereof. The spring 18 may be of any suitable material but is preferably stainless steel.

The waste pipe 3 can be fitted to any sink or any other unit in known manner. The plug 2 can then be inserted into the waste pipe 3 and the hole 17 and slot 14 aligned. The pin can then be secured in place.

Turning to FIG. 3, a second preferred embodiment of the plug unit 13 is thereshown. This embodiment shows the plug 2 of the present invention in a form appropriate for use with a remotely operated plug. Like numbers are used in accordance with the like parts from the first preferred embodiment. Variations from the first embodiment include a collar 29 which is threaded onto the outside of the waste pipe 3. The collar 29 incorporates a pin 17*a* and a straight slot 14. On the side opposite the pin 17*a* is the remote pin 34 for operation of the remote control of the plug 2. The operation of that plug 2 could be as described in PCT/NZ96/00031.

Alternately, the spring shrouding could form part of any other remotely operated plug with spring means to bias the plug to an open position.

The plug assembly unit of either preferred embodiment can be assembled and sold with the waste pipe unit. However, it will be appreciate that a standard waste pipe unit could be adapted to fit the plug 2 and shrouded spring 18 with a minimum of work to form the shoulder 6 such that the interior of the wall of the waste pipe 3 has two portions with two different interior diameters.

We claim:

1. A plug assembly unit including:

a sink waste pipe unit of known type;

a plug with a closed top and side with holes formed in the side for the draining of fluid therethrough;

means for draining fluid from said sink to said pipe;

means to move the plug between an open and the closed position;

means to enable said plug to be left in an open position which includes a spring means;

said plug assembly unit including inter-engaging means for said pipe and plug and means to secure said plug relative to said pipe such that said plug can be moved relative to said pipe but cannot be removed therefrom under normal operating conditions; wherein said opening means and means to leave the plug in the open position includes spring means positioned between the plug and the waste pipe; wherein said plug can be moved between the open and the closed position and said fluids drain through at least one peripheral hole in said plug through the interior of said plug to the pipe; and wherein the arrangement of the plug sides, the means to enable the plug to be left in the open position and the opening means is such that said fluid does not touch said spring means when said fluid passes through said plug to the pipe.

2. A plug assembly unit as claimed in claim 1 wherein said spring means is positioned in an annular cavity, which cavity can vary in size between a maximum size, when the plug is in the open position, and a minimum size, when the plug is in the closed position; wherein said cavity is formed between:

a first shoulder formed in the outside of the plug side and positioned below said holes;

a portion of the outside of the plug side below said first shoulder, the diameter of said portion being less than that of the remainder of the side of the plug;

a second shoulder formed on the interior wall of the waste pipe such that a top portion of the waste pipe has an internal diameter greater than that of a lower portion of the waste pipe; and at least a part of said top portion of the waste pipe; and wherein said spring means is compressed when the plug is in the open position and further compressed when the plug is in the closed position.

3. A plug assembly unit as claimed in claim 2 wherein said spring means is a spring.

4. A plug assembly unit as claimed in claim 1 wherein said spring means is a spring.

5. A plug assembly unit as claimed in claim 4 wherein said assembly is capable of manual operation.

6. A plug assembly unit as claimed in claim 4 wherein said assembly is capable of being remotely operated.

7. A plug assembly unit as claimed in claim 1 wherein said assembly is capable of manual operation.

8. A plug assembly unit as claimed in claim 1 wherein said assembly is capable of being remotely operated.

9. A plug assembly including:

a plug with a closed top and side with holes formed in the side for the draining of fluid therethrough;

means for draining fluid from said sink to a sink waste pipe;

means to move the plug between an open and a closed position;

means to enable said plug to be left in the open position which includes a spring means;

said plug assembly unit including inter-engaging means for said pipe and plug and means to secure said plug relative to said pipe such that said plug can be moved relative to said pipe but cannot be removed therefrom under normal operating conditions; wherein said opening means and means to leave the plug in the open position includes spring means positioned between the plug and the waste pipe;

wherein said plug can be moved between the open and the closed position and said fluids drain through at least one peripheral hole in said plug through the interior of said plug to the pipe; and wherein the arrangement of the plug sides, the means to enable the plug to be left in the open position and the opening means is such that said fluid does not touch said spring means when said fluid passes through said plug to the pipe.

10. A plug assembly as claimed in claim 9 wherein said spring means is positioned in a annular cavity, which cavity can vary in size between a maximum size, when the plug is in the open position, and a minimum size, when the plug is in the closed position; wherein said cavity is formed between:

a first shoulder formed in the outside of the plug side and positioned below said holes;

a portion of the outside of the plug side below said first shoulder, the diameter of said portion being less than that of the remainder of the side of the plug;

a second shoulder formed on the interior wall of the waste pipe such that a top portion of the waste pipe has an internal diameter greater than that of a lower portion of the waste pipe; and at least a part of said top portion of the waste pipe; and wherein said spring means is compressed when the plug is in the open position and further compressed when the plug is in the closed position.

11. A plug assembly as claimed in claim 9 wherein said spring means is a spring.

12. A plug assembly as claimed in claim 9 wherein said assembly is capable of manual operation.

13. A plug assembly as claimed in claim 9 wherein said assembly is capable of being remotely operated.

* * * * *